US006164610A

United States Patent [19]

Santiago

[11] Patent Number: 6,164,610

[45] Date of Patent: Dec. 26, 2000

[54] CONCEALED CANTILEVER SHELF SUPPORT

[76] Inventor: Jacob C. Santiago, 40-04A Bell Blvd., Bayside, N.Y. 11361

[21] Appl. No.: 09/187,262

[22] Filed: Nov. 6, 1998

[51] Int. Cl.[7] ..... A47G 29/02; E04G 3/08; E06B 7/28; A47F 5/08

[52] U.S. Cl. ..... 248/235; 211/90.01

[58] Field of Search ..... 248/235, 248, 248/250, 247, 220.1, 239; 211/90.01, 193, 186, 153, 90.02; 108/152, 102, 108, 137

[56] References Cited

U.S. PATENT DOCUMENTS

| | | | |
|---|---|---|---|
| 910,616 | 1/1909 | Waters | 248/239 |
| 1,599,653 | 9/1926 | Cranston | 248/235 |
| 2,389,349 | 11/1945 | Eastman | 211/90.01 |
| 2,991,038 | 7/1961 | Vitiello | 248/250 |
| 3,381,636 | 5/1968 | Saiberlich | 108/108 |
| 3,386,390 | 6/1968 | Gretz | 211/189 |
| 3,490,393 | 1/1970 | Nelson | 248/250 |
| 3,754,518 | 8/1973 | Wachtel | 108/152 |
| 3,896,718 | 7/1975 | Giambalvo | 108/108 |
| 4,381,715 | 5/1983 | Forman | 108/152 |
| 4,441,433 | 4/1984 | Caldwell | 211/90.01 |
| 4,541,600 | 9/1985 | Vieglins | 248/239 |
| 4,568,050 | 2/1986 | Radoy et al. | 248/239 |
| 4,886,236 | 12/1989 | Randall | 248/250 |
| 4,898,355 | 2/1990 | Steinway | 248/235 |
| 5,513,575 | 5/1996 | Slade | 248/239 |
| 5,799,588 | 9/1998 | Engel | 108/108 |
| 5,954,306 | 9/1999 | Hoover | 248/500 |

*Primary Examiner*—Ramon O. Ramirez
*Assistant Examiner*—Tyrone DeLuca
*Attorney, Agent, or Firm*—Michael I. Kroll

[57] ABSTRACT

The present invention discloses a modular shelf mounting system 10 having a bracket member 20 for mounting and supporting a shelf member 12. The bracket member 20 has multiple holes 22 therein for having its rear side mounted to a wall 14 at the stud locations. Furthermore, the bracket 20 has forwardly projecting multiple cantilevered male members 18 which cantilevered members are inserted into mating female apertures 16 located in the shelf 12 whereby the shelf 12 can be slidably attached onto the cantilevered members 18. Alternative embodiments are shown for placement of the shelf in a corner and having the cantilevered members hinged 26 at their base. An additional embodiment is shown wherein the shelf is mounted onto the bracket 36 using multiple attachment means 42 thereby avoiding the need of the cantilevered forwardly projecting members 18.

6 Claims, 16 Drawing Sheets

CONCEALED CANTILEVER SHELF SUPPORT

BACKGROUND OF THE INVENTION

1. Field of the Invention

The present invention relates generally to shelf mounting systems and more specifically to a bracket having a plurality of fastener mounting holes and having a number of cantilevered forwardly projecting members forming the supports for a shelf having mating female cavities on one or more edges for receiving said male cantilevered supports and bracket thereby providing a shelf with concealed mounting members.

2. Description of the Prior Art

There are other shelf mounting systems designed to provide low footprint shelf support members. Typical of these is U.S. Pat. No. 3,386,590 issued to Gretz on Jun. 4, 1968.

Another patent was issued to Forman on May 3, 1983 as U.S. Pat. No. 4,381,715. Yet another U.S. Pat. No. 4,886,236 was issued to Randall on Dec. 12, 1989 and still yet another was issued on Feb. 6, 1990 to Steinway as U.S. Pat. No. 4,898,355.

U.S. Pat. No. 3,386,590

Inventor: Charles Gretz

Issued: Jun. 4, 1968

A construction kit is provided in the form of hollow tubular pieces of square cross section in various shapes and lengths. The tubular pieces are basic and comprise a channel which forms three sides and a panel which forms the fourth side. The panel is connected to the channel by interlocking members on the interior of the channel. The outermost of these interlocking members are recessed from the outer ends of the tubular pieces to form abutments for mating pieces. The pieces are made of a rigid plastic material, the surface of which is treated to simulate an artistic metal. These interlocking pieces may have two, three or more ends for various design configurations. Ancillary pieces are also provided, such as scrolls and plates, together with connectors for attaching them to the basic pieces.

U.S. Pat. No. 4,381,715

Inventor: David M. Forman

Issued: May 3, 1983

A novel shelf support system which is capable of bearing heavy loads and provides a large measure of adjustability, yet is completely self contained and only very minimally visible where the shelf meets the wall. The system comprises threaded fasteners for securement to a wall, e.g. at the stud locations, each fastener bearing a support shaft and a spring clip for interengagement with detent grooves which run lengthwise of elongated recessed chambers within the shelf.

U.S. Pat. No. 4,886,236

Inventor: Harold M. Randall

Issued: Dec. 12, 1989

A support for a shelf having a top surface, a bottom surface, a rear wall, and a front wall. The support includes a bracket having a throat for receiving the rear wall of a shelf; and one or more wedges for being inserted between the shelf and the throat of the bracket after the rear wall of the shelf has been received by the throat of the bracket to fix the shelf to the bracket. The shelf is attached to a wall by securing the bracket secured to the support member at the desired location; inserting the rear wall of the shelf into the throat of the bracket until the rear wall is adjacent the rear of the throat; and then inserting one or more wedge members into the throat of the bracket between the top surface of the shelf and the bottom surface of an upper arm of the bracket to fix the shelf to the bracket.

U.S. Pat. No. 4,898,355

Inventor: Steven Steinway

Issued: Feb. 6, 1990

The present invention is a mounting structure for glass shelving or a glass wall panel. The mounting structure has a supporting bar which may be an elongated member or a u-shaped member, and an attachment bracket. The rod or bar is used to support the shelf or wall panel. The bracket attaches the supporting bar to a support surface, which is preferably an inner stud. The bracket is generally rectangular in shape, having an elongated hollow interior area for receiving and securing the supporting bar. The supporting bar can be mounted vertically on the stud, extending through a wall or can be directly mounted on the outer wall in either a vertical or horizontal orientation.

While these shelf mounting systems may be suitable for the purposes for which they were designed, they would not be as suitable for the purposes of the present invention, as hereinafter described.

SUMMARY OF THE PRESENT INVENTION

The present invention discloses a modular shelf mounting system having a bracket member for mounting and supporting a shelf member. The bracket member has multiple holes therein for having its rear side mounted to a wall at the stud locations. Furthermore, the bracket has forwardly projecting multiple cantilevered male members which cantilevered members are inserted into mating female apertures located in the shelf whereby the shelf can be slidably attached onto the cantilevered members. Alternative embodiments are shown for placement of the shelf in a corner and having the cantilevered members hinged at their base. An additional embodiment is shown wherein the shelf is mounted onto the bracket using multiple attachment means thereby avoiding the need of the cantilevered forwardly projecting members.

A primary object of the present invention is to provide a shelf having concealed support members.

Another object of the present invention is to provide a bracket having means for attachment to a wall.

Yet another object of the present invention is to provide a shelf having a bracket with a number of forwardly projecting cantilevered members.

Still yet another object of the present invention is to provide a shelf with a number of apertures wherein the brackets cantilevered members will be inserted.

Additional objects of the present invention will appear as the description proceeds.

The present invention overcomes the shortcomings of the prior art by providing a bracket which can be attached to a wall and having a number of cantilevered forwardly projecting members whereby a shelf having a number of apertures will slid over and conceal the brackets projecting members.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
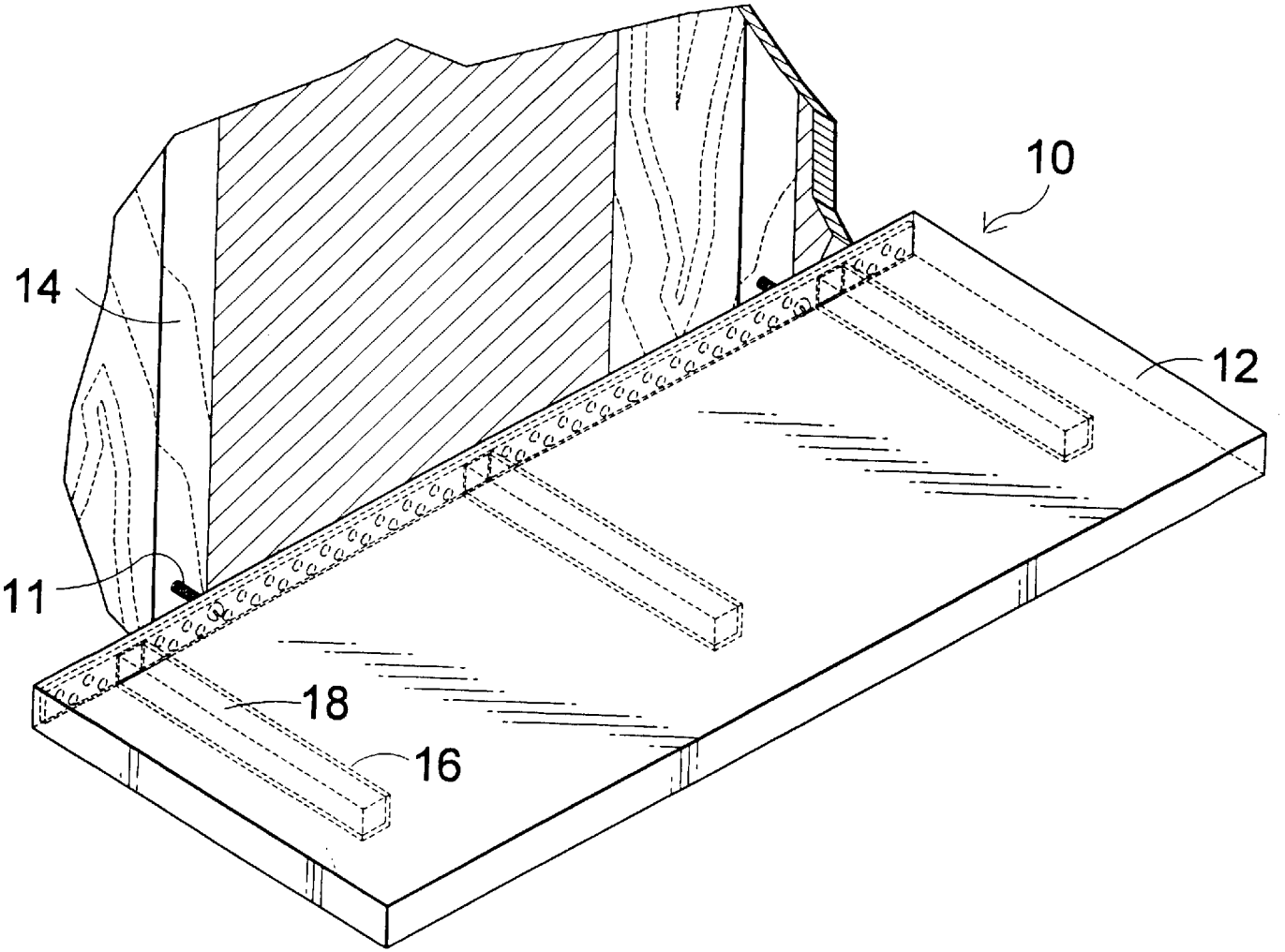
FIG. 1 is a perspective view of the present invention. Shown is a shelf support module mounted to the studs of a wall. Shown in outline are the apertures within the shelf therein housing the bracket and cantilevered support members.

With regard to the reference numerals used, the following numbering is used throughout the various figures.

10 present invention
11 wall mounting means
12 shelf
14 stud
16 shelf apertures
18 cantilevered members
20 bracket
22 bracket holes
24 bracket recess
26 hinged cantilevered member
28 mounting means
30 fastener means
32 corner attachment means
34 pin
36 alternative bracket
38 mounting holes
40 screws
42 screw apertures

DESCRIPTION OF THE PREFERRED EMBODIMENTS

Turning now descriptively to the drawings, in which similar reference characters denote similar elements throughout the several views, FIGS. 1 through 16 illustrate the present invention being a modular shelf mounting system.

Turning to FIG. 1, therein is shown a perspective view of the present invention generally shown at 10. Also shown therein is the shelf 12 and the wall 14 to which the present invention 10 mounts the shelf 12. Shown is the shelf support module of the present invention 10 mounted to the studs 14 of the wall using wall mounting means 11 which could be screws or other standard means. Shown in outline are the mating female apertures 16 within the shelf 12 therein housing the elongated cantilevered support male members 18 shown in outline.

Figure 2:
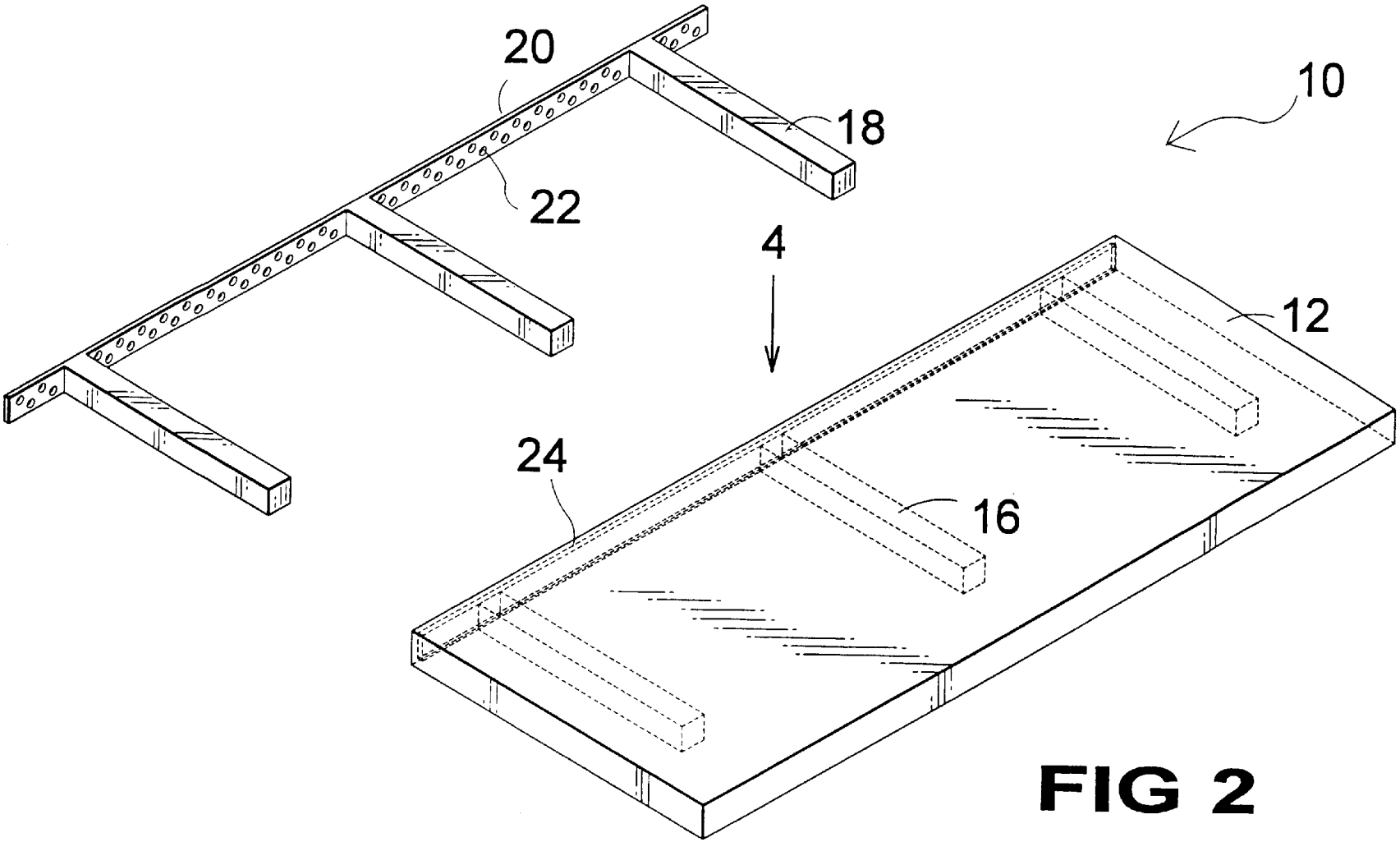
FIG. 2 is an unexploded perspective view of the present invention. Shown is the bracket member with a plurality of fastener mounting apertures whereby the shelf module can be mounted without regard to stud location. Also shown is the shelf with the apertures within the shelf for the support members and the cavity for the bracket shown in outline.

Turning to FIG. 2, therein is shown an exploded perspective view of the present invention 10. Also shown is the bracket member 20, the male support member 18, with a plurality of fastener mounting holes or apertures 22 through which fastener means pass for mounting to the wall. The multiple holes 22 allow the bracket member to be mounted to the studs without regard to the stud location. Also shown is the shelf 12 with the female apertures 16 within the shelf. Note the recess or cavity 24 on the rear edge of the shelf 12 wherein the mounting bracket 20 rests to allow the rear edge of the shelf 12 to be mounted flush with the wall. In operation, the bracket 20 is mounted onto a wall and the shelf 12 is then mounted onto the bracket.

Figure 3:
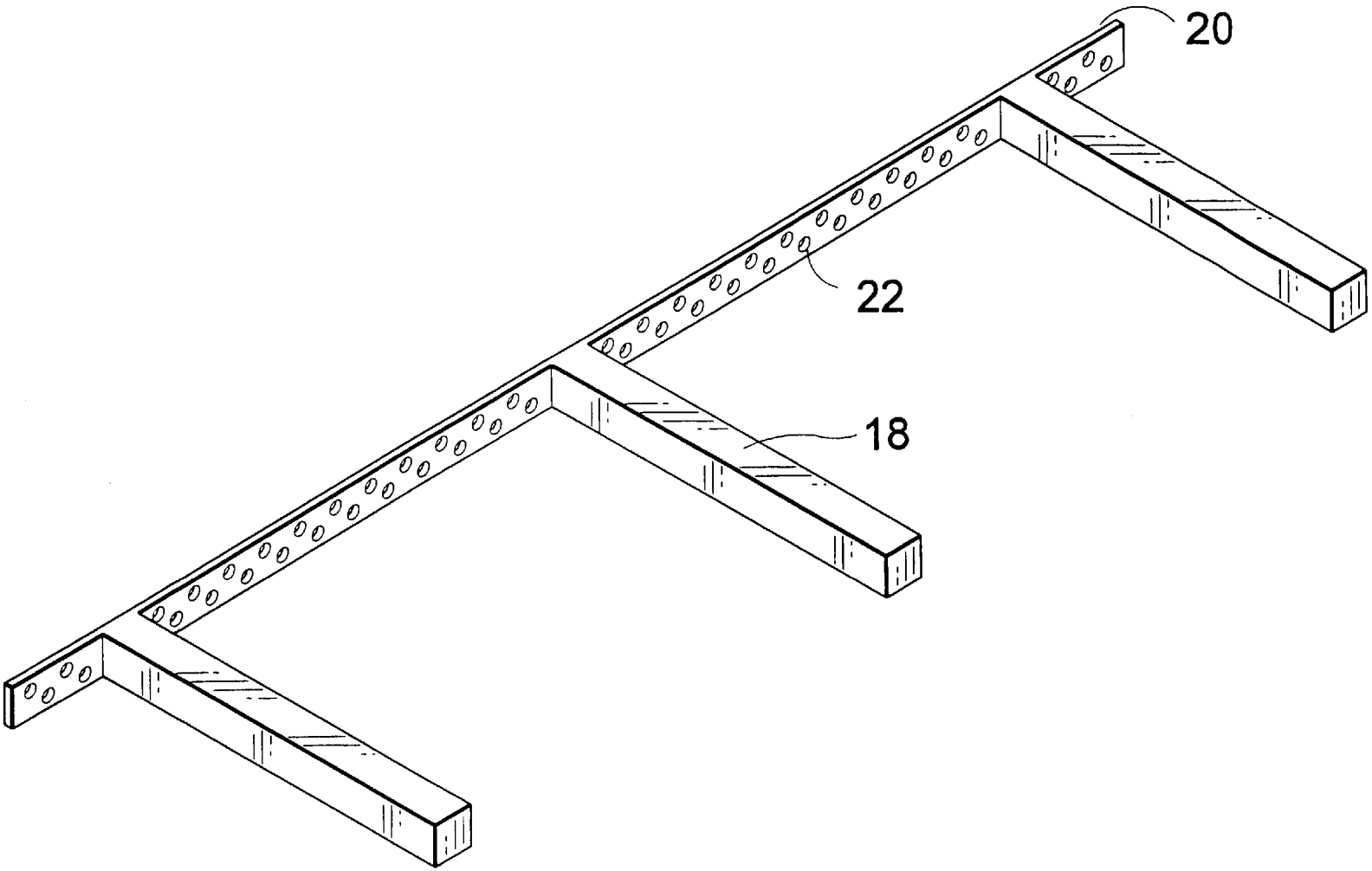
FIG. 3 is an enlarged perspective view of the preferred embodiment of the bracket of the present invention having a plurality of fastener mounting apertures.

Turning to FIG. 3, therein is shown an enlarged view of the preferred embodiment of the bracket 20 of the present invention having a plurality of apertures 22 for being mounted to a wall (not shown). Also shown therein are the cantilevered members 18 of the bracket 20 which mount into the shelf apertures 16 (not shown).

Figure 4:
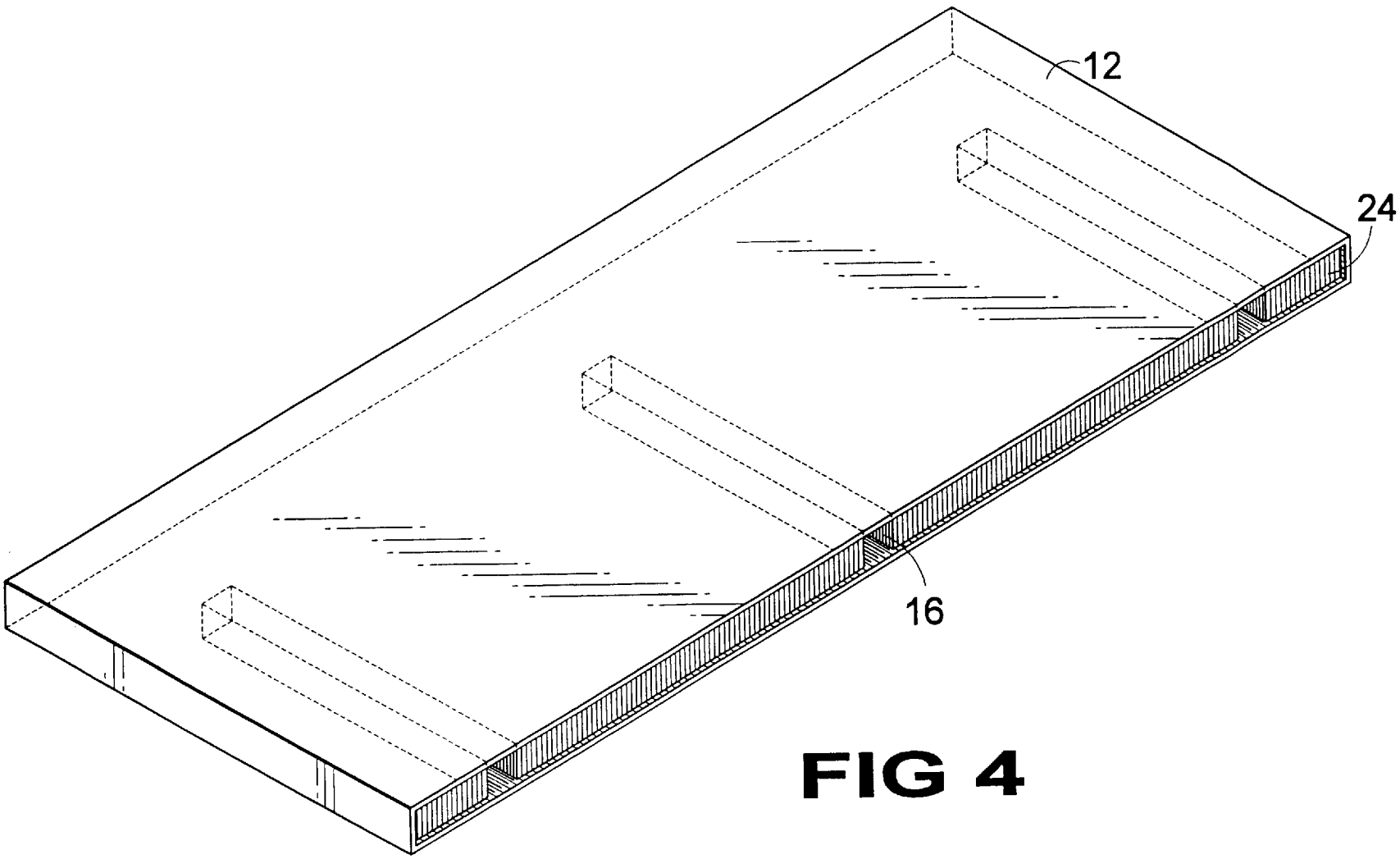
FIG. 4 is a back perspective view of the preferred embodiment of the shelf of the present invention showing the apertures for the bracket and support members.

Turning to FIG. 4, therein is shown a back perspective view of the preferred embodiment of the shelf 12 of the present invention showing the female shelf apertures, 16 in which the male cantilevered members 18 are slidably and removably mounted. Also shown therein is the recessed area 24 on the back edge of the shelf wherein the bracket 20 is mounted.

Figure 5:
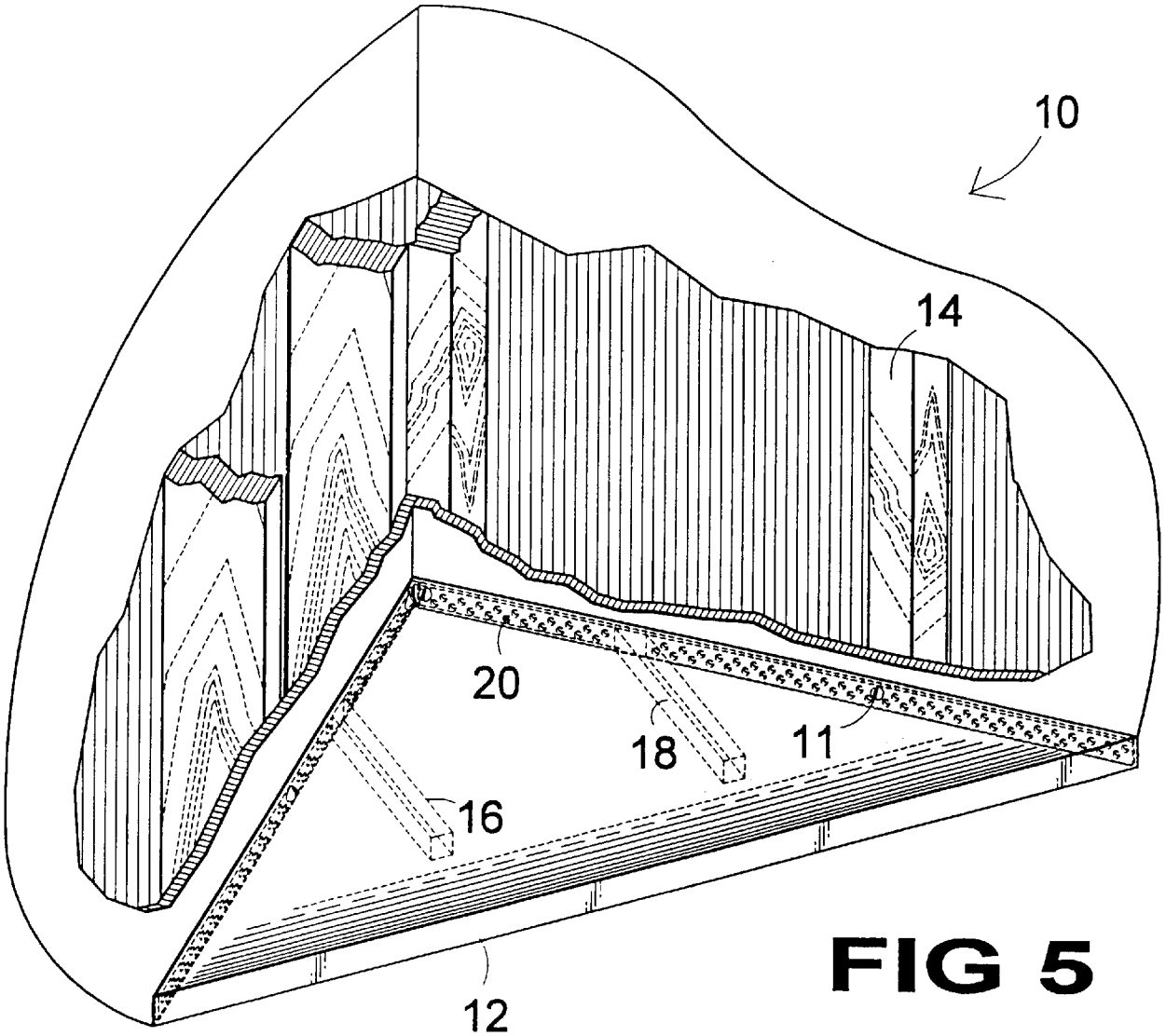
FIG. 5 is a front perspective view of an alternate embodiment of the present invention showing a corner shelf module mounted to the studs of a wall. Shown in outline are the apertures within the shelf and with the bracket and cantilevered support members inserted.

Turning to FIG. 5, therein is shown a front perspective view of an alternative embodiment of the present invention 10 showing a corner shelf module mounted to the studs 14 of the wall. Shown in outline are the apertures 16 of the shelf 12 with the bracket 20 and cantilevered support members 18 mounted therein along with wall mounting means 11.

Figure 6:
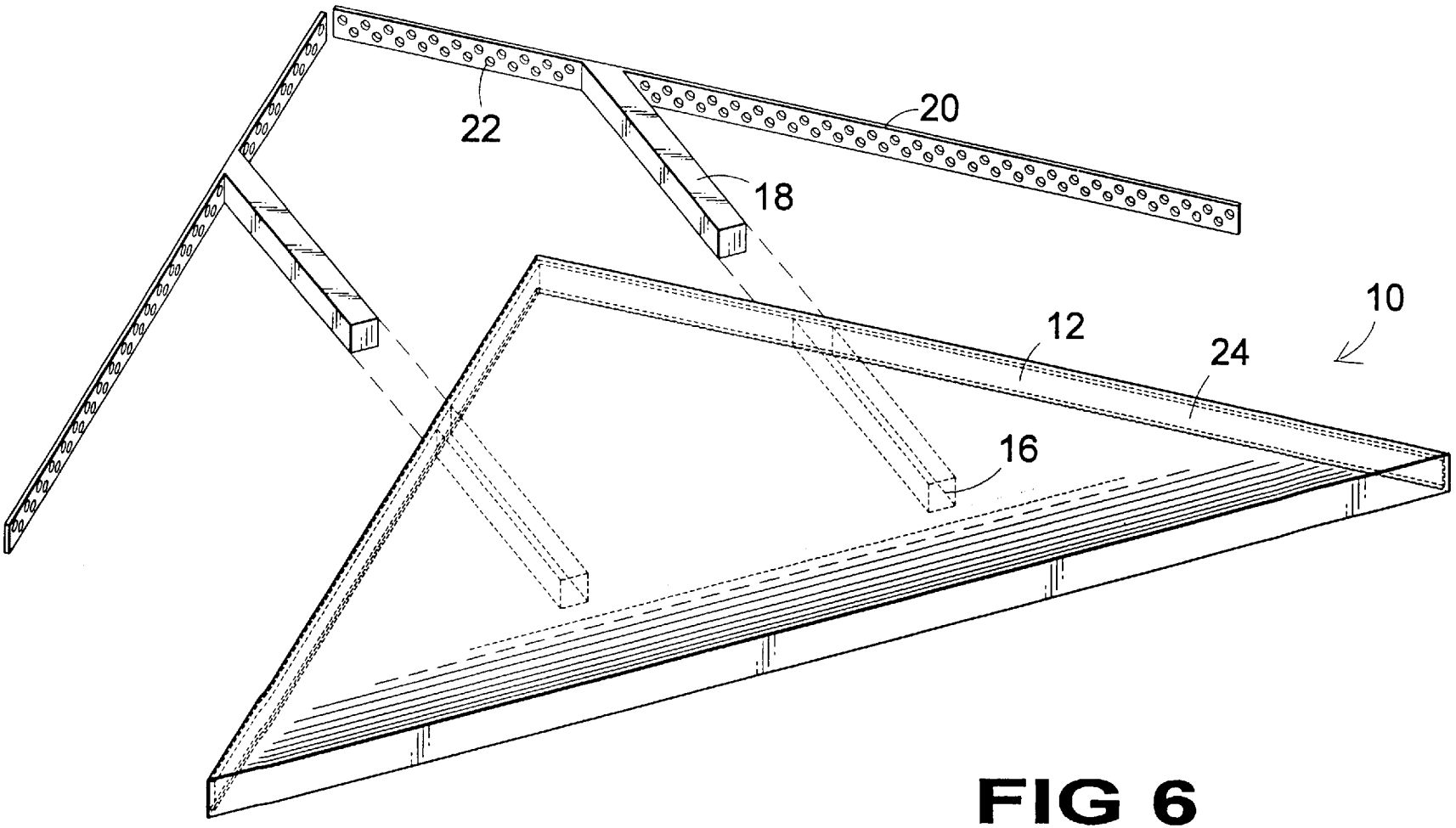
FIG. 6 is an exploded perspective view of the alternate embodiment of the present invention. Shown are the bracket members with a plurality of fastener mounting apertures whereby the shelf module can be mounted without regard to stud location. Also shown is the shelf with the apertures within the shelf for the support members and the cavity for the bracket shown in outline.

Turning to FIG. 6, therein is shown an exploded perspective view of the alternative embodiment of the present invention 10. Shown are the bracket members 20 with a plurality of mounting apertures 22 therein whereby the shelf module can be mounted in a variety of locations on the stud wall. Also shown therein is the shelf 12 with the apertures 16 in which the cantilevered support members 18 are mounted. Also shown is the bracket recess areas 24 on the back edges of the triangular shaped shelf 12.

Figure 7:
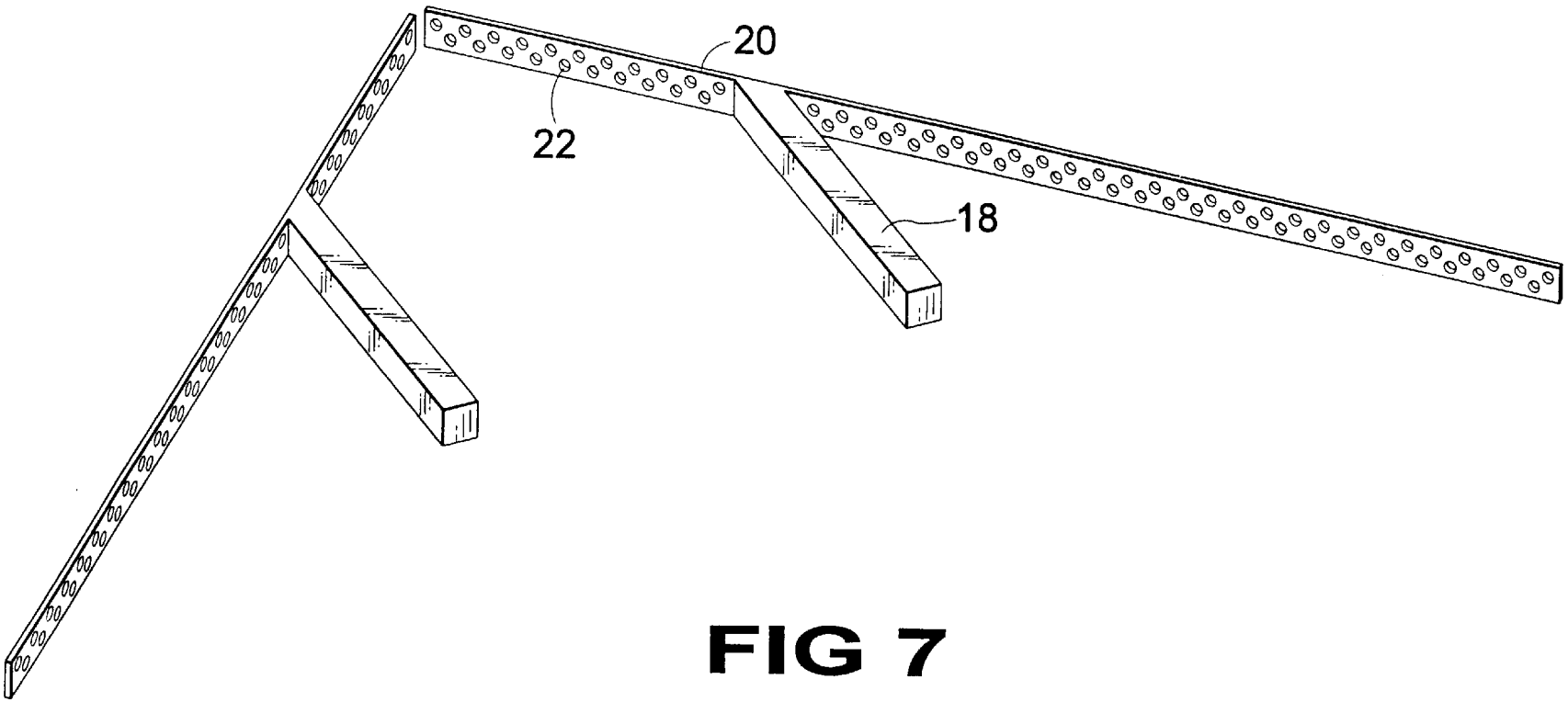
FIG. 7 is an enlarged perspective view of the alternate embodiment of the bracket of the present invention having a plurality of fastener mounting apertures. The bracket is composed of two members which compensate for corners which are not generally square.

Turning to FIG. 7, therein is shown an enlarged perspective view of the alternative embodiment of the bracket 20 of the present invention having a plurality of fastener mounting apertures 22. The bracket is composed of two members which when mounted compensate for irregular corners which are not exactly square. Also shown therein are the cantilevered members 18.

Figure 8:
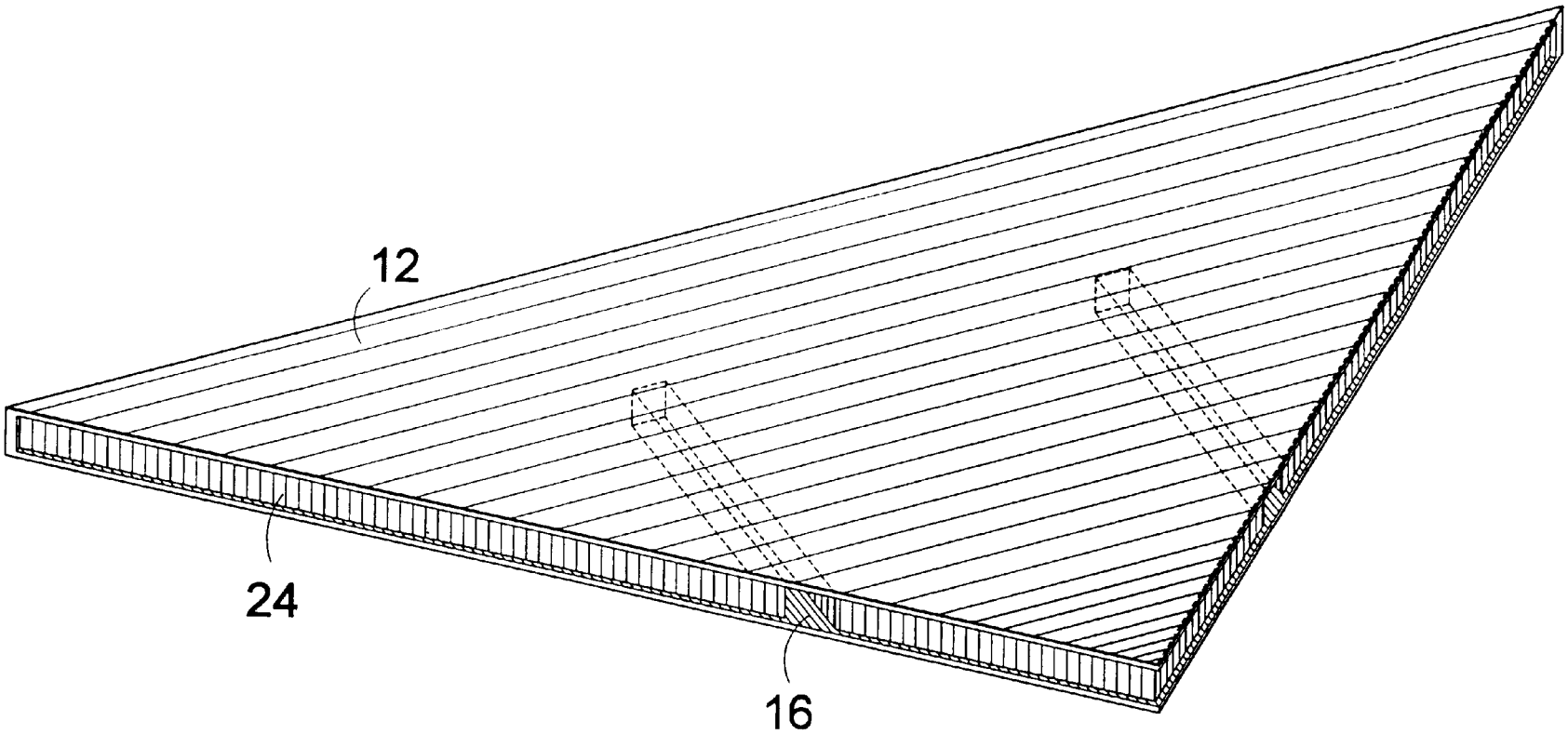
FIG. 8 is a back perspective view of the alternate embodiment of the shelf of the present invention showing the apertures for the bracket and support members.

Turning to FIG. 8, therein is shown a back perspective view of the alternative embodiment of the shelf 12 of the present invention showing the apertures 16 for the bracket and cantilevered support members. Also shown are the recessed areas 24 wherein the bracket (not shown) is inserted to be flush with the shelf 12.

Figure 9:
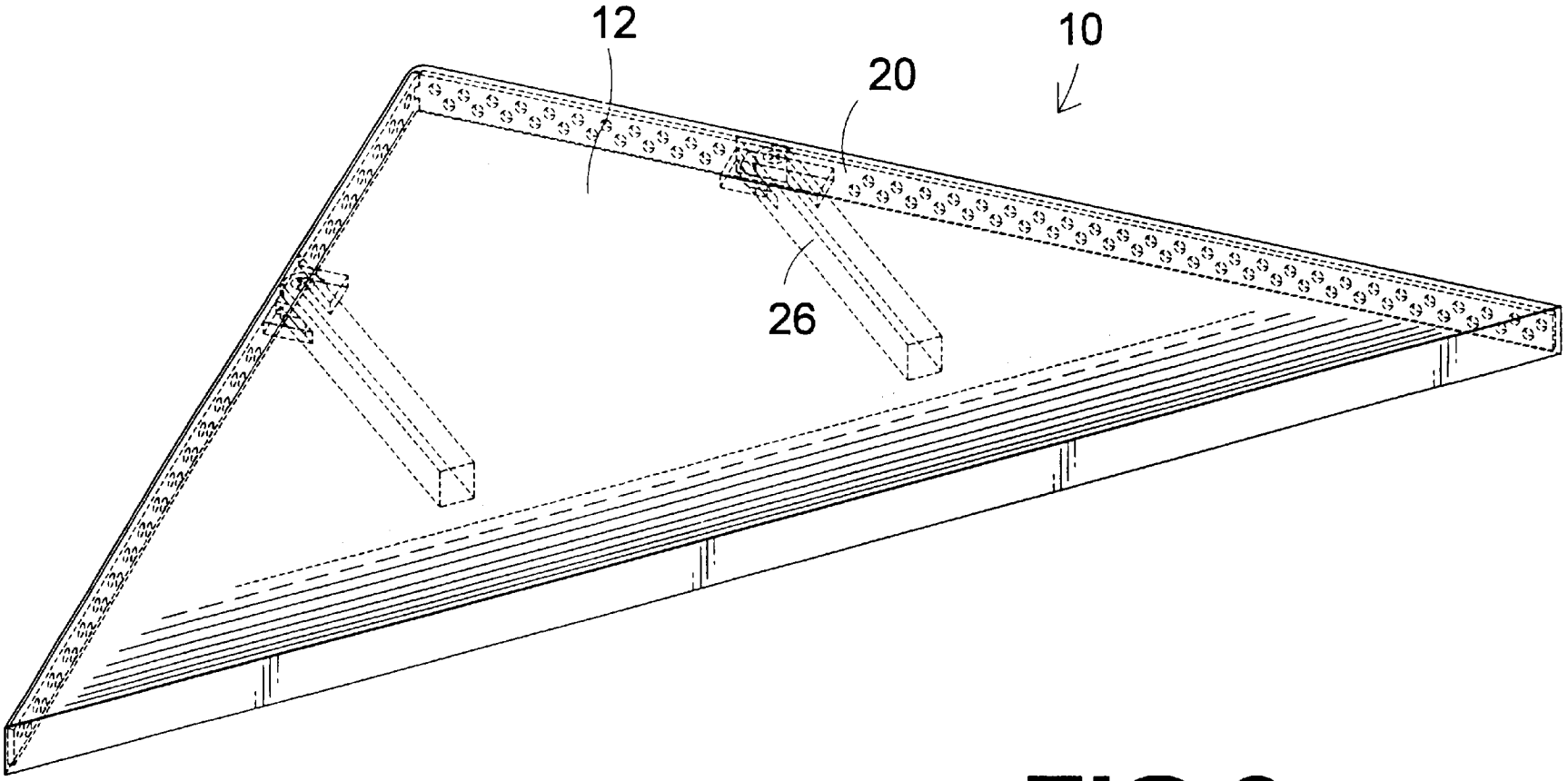
FIG. 9 is a front perspective view of the additional alternate embodiment of the present invention showing a corner shelf with the bracket having two hinged cantilevered members shown in outline.

Turning to FIG. 9, therein is shown a front perspective view of an additional alternative embodiment of the present invention 10 showing a modular shelf corner 12 with the bracket 20 having two hinged cantilever members 26 shown in outline attached thereto.

Figure 10:
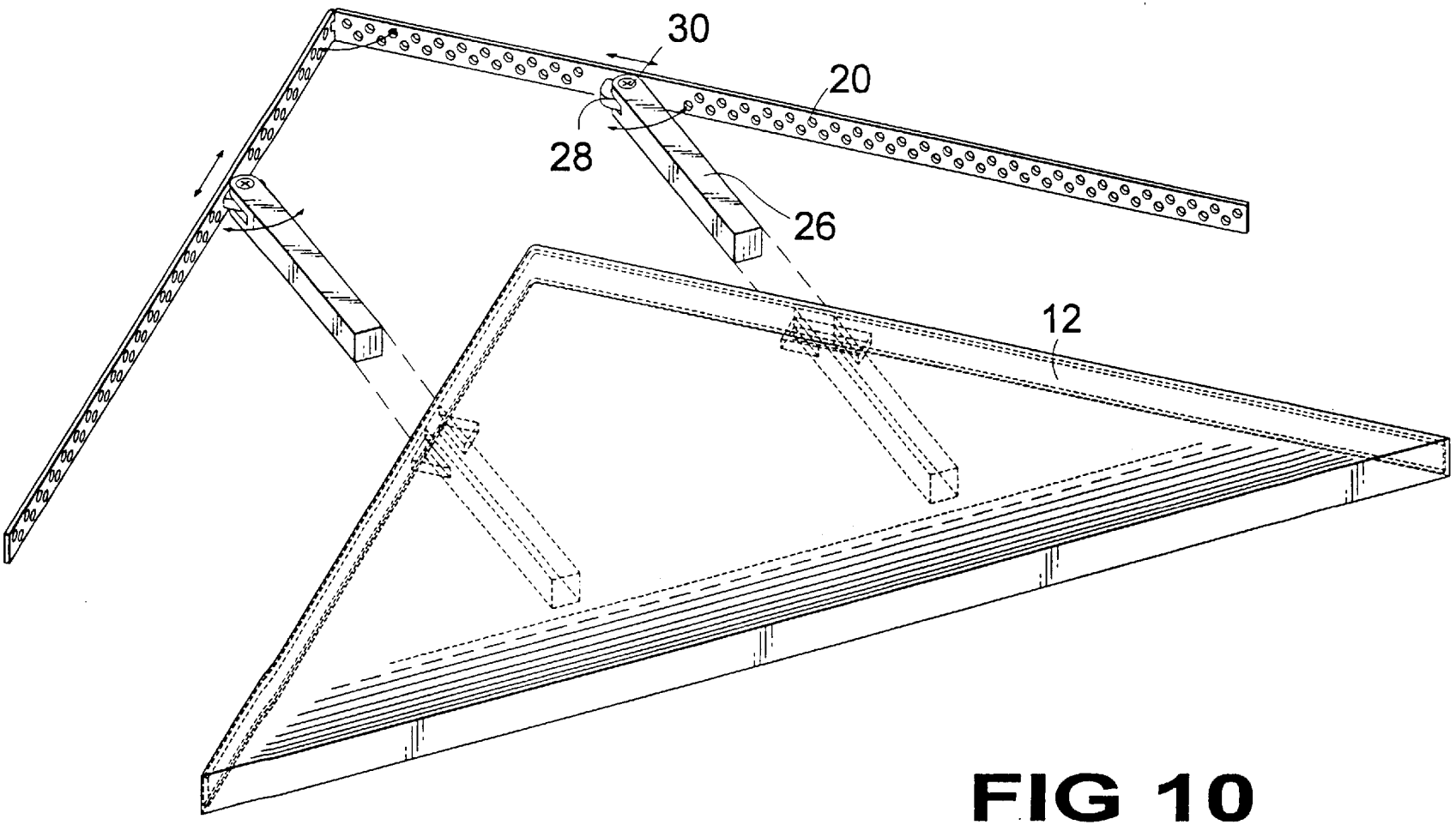
FIG. 10 is an exploded front perspective view of the additional alternate embodiment of the present invention showing the corner shelf removed from the bracket having two hinged cantilevered members.

Turning to FIG. 10, therein is shown an exploded front perspective view of an additional embodiment of the present invention showing the corner shelf 12 removed from the bracket 20 having two hinged cantilevered members 26. Also shown therein are the cantilevered member mounting means 28 attached to the bracket 20 having additional fastening means 30 whereby the cantilevered members 26 are connected onto the mounting means 28 and thereby to the bracket 20. Note that the attachment means 28 and 30 further provide pivoting means.

Figure 11:
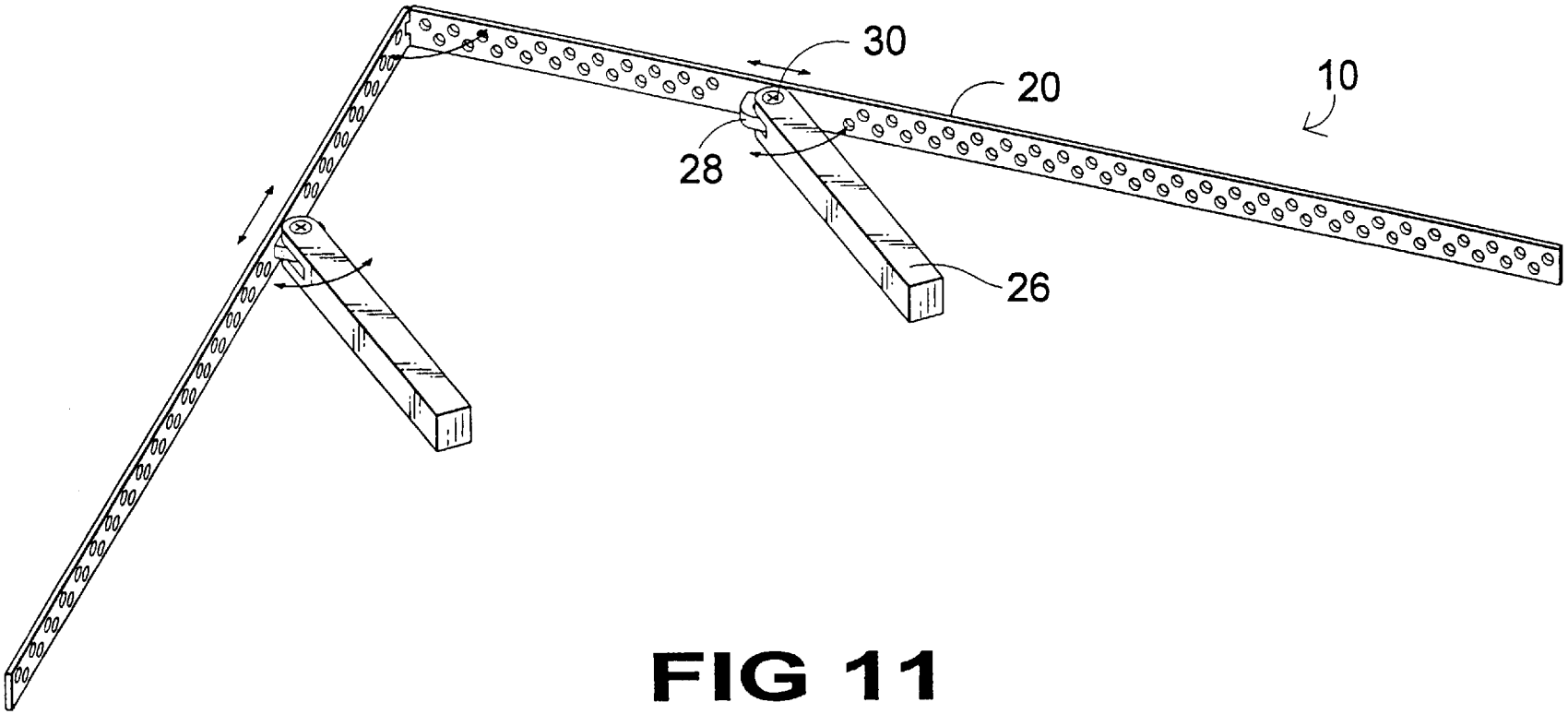
FIG. 11 is a front perspective view of the additional alternate embodiment of the bracket of the present invention showing means for attachment of the two hinged members of the bracket to the wall, as well as, two cantilevered shelf support members.

Turning to FIG. 11, therein is shown a front perspective view of an additional alternative embodiment of the bracket 20 of the present invention 10 showing means for attachment of the two hinged members 26 of the bracket 20 to the wall as well as two cantilevered shelf support means 26. Also shown therein are the mounting means 28 and attachment means 30.

Figure 12:
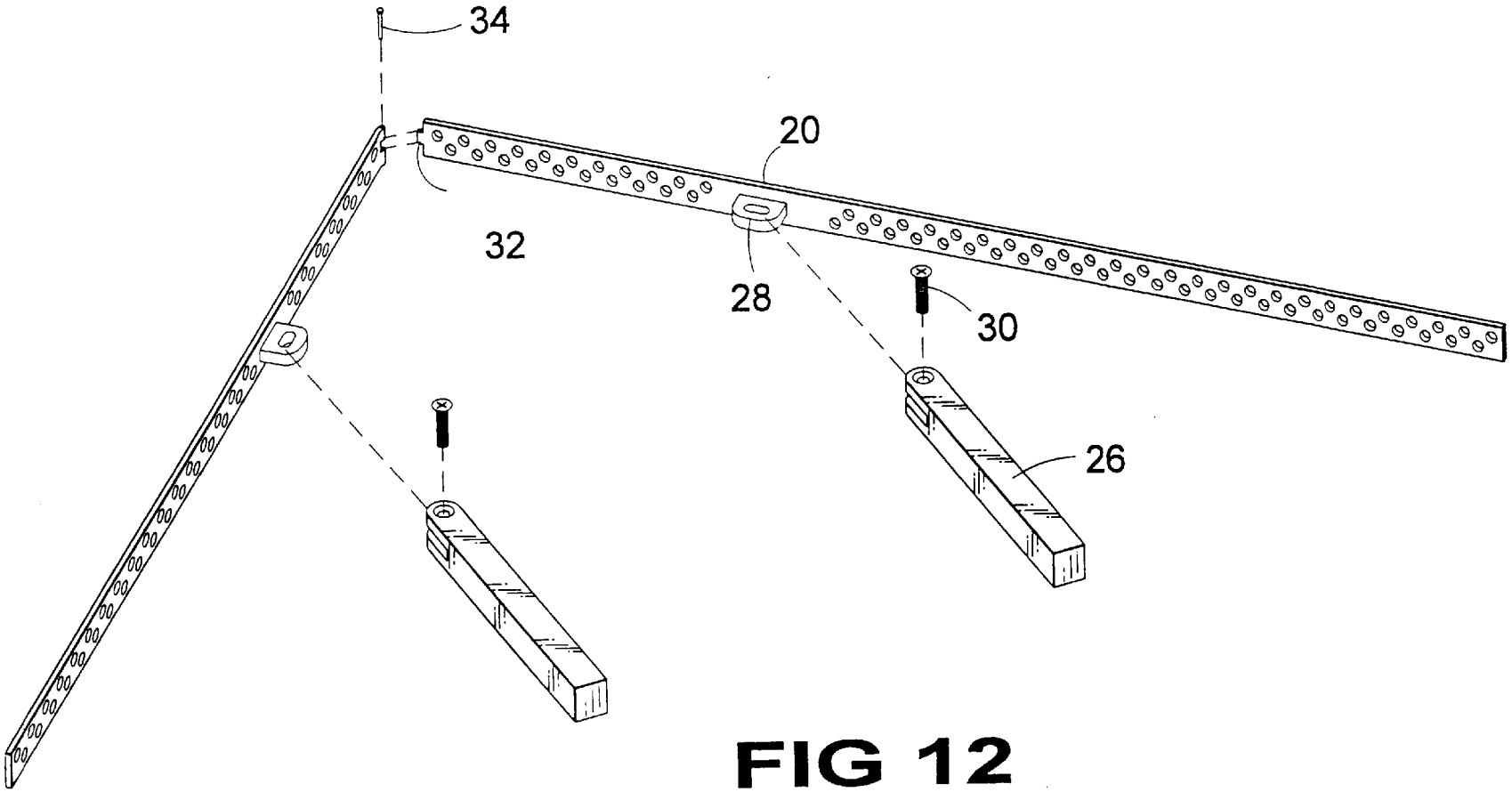
FIG. 12 is an exploded view of the additional alternate embodiment of the bracket of the present invention showing means for attachment of the two hinged bracket members as well as, two hinged cantilevered shelf support members whereby the shelf and support members are adjustable to an inside or outside corner.

Turning to FIG. 12, therein is shown an exploded view of the additional alternative view of the bracket 20 of the present invention showing means for attachment 32, being a hinge having a pin 34 and groove, of the two hinged bracket members 20 as well as two hinged cantilevered shelf support members 26 whereby the shelf and support members are adjustable to an inside or an outside corner.

Figure 13:
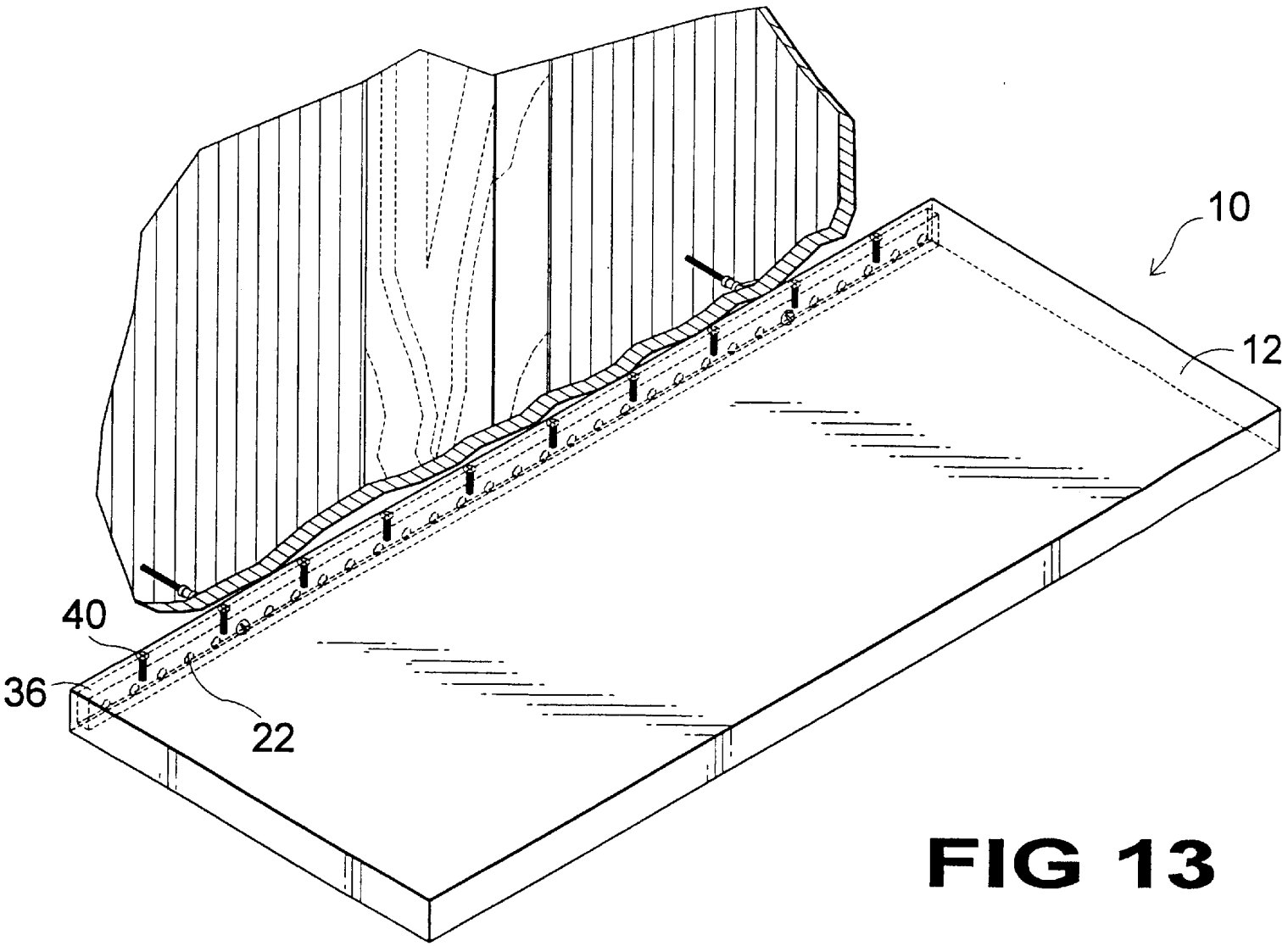
FIG. 13 is a perspective view of another additional embodiment of the present invention. Shown is a shelf support module mounted to the studs of a wall. Shown in outline is the aperture for the bracket within the shelf therein housing the bracket.

Turning to FIG. 13, therein is shown a perspective view of another additional embodiment of the present invention 10. Shown is an alternative shelf support module 36 mounted to the wall using wall mounting means 11. Shown in outline are the apertures 22 for the bracket 36 within the shelf 12 therein housing the bracket 36. Also shown therein are mounting screws 40 into the female threaded holes (not shown) which attach the shelf 12 to the alternative bracket 36.

Figure 14:
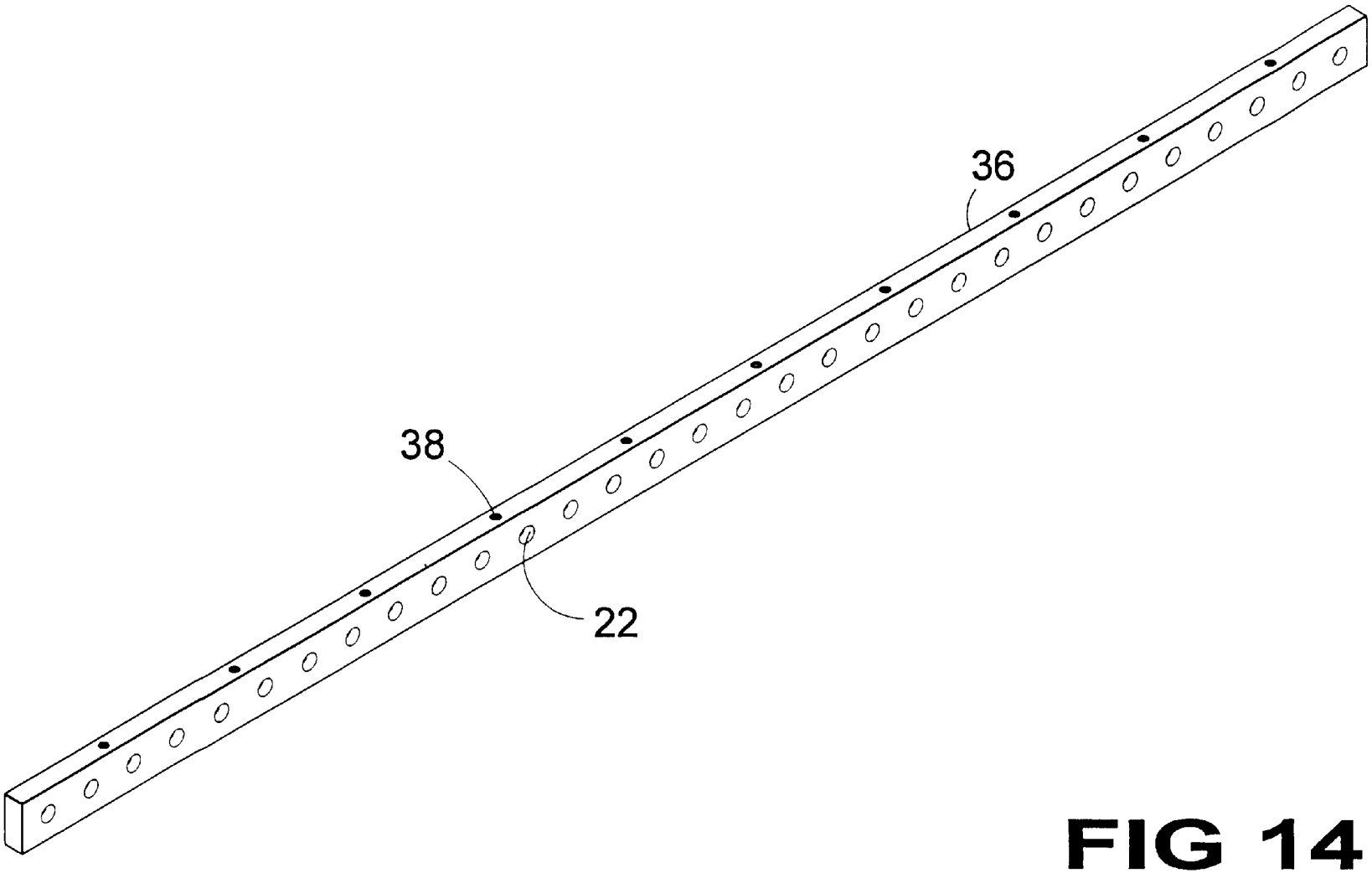
FIG. 14 is an exploded perspective view of the other additional embodiment of bracket of the present invention. Shown is the bracket member with a plurality of fastener mounting apertures whereby the shelf module can be mounted without regard to stud location.

Turning to FIG. 14, therein is shown an exploded perspective view of the additional alternative embodiment of the bracket 36 of the present invention. Shown is the bracket member 36 with a plurality of fastener mounting apertures 22 whereby the shelf module can be mounted without regard to stud location along with the threaded holes 38.

Figure 15:
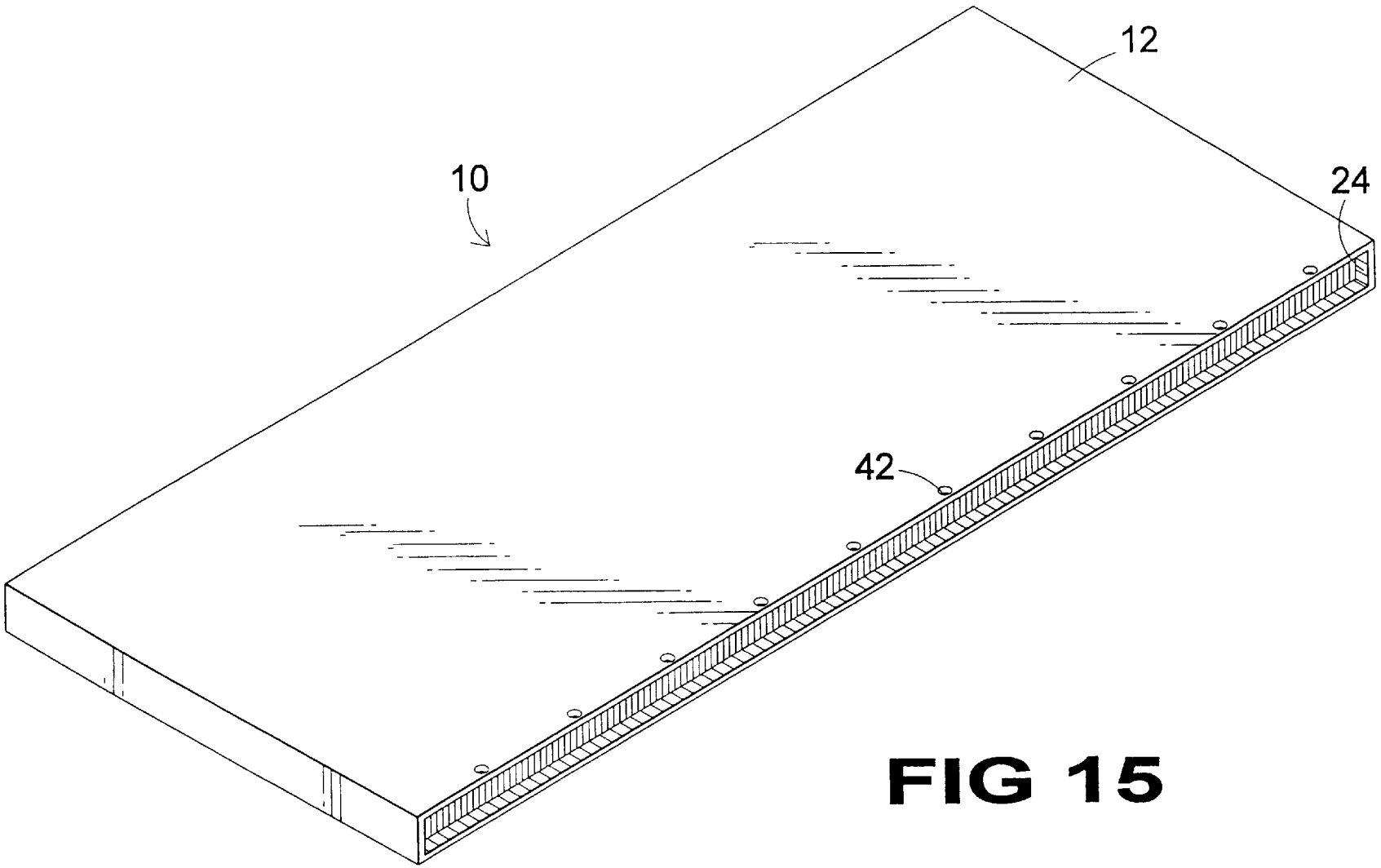
FIG. 15 is an rear perspective view of the additional alternate embodiment of the shelf of the present invention showing the aperture for the bracket.

Turning to FIG. 15, therein is shown a rear perspective view of the additional alternative embodiment of the shelf 12 of the present invention 10 showing the apertures 42 through the which screws 40 are inserted to attach the shelf 12 to the alternative bracket 36. A bracket recess area 24 is also shown.

Figure 16:
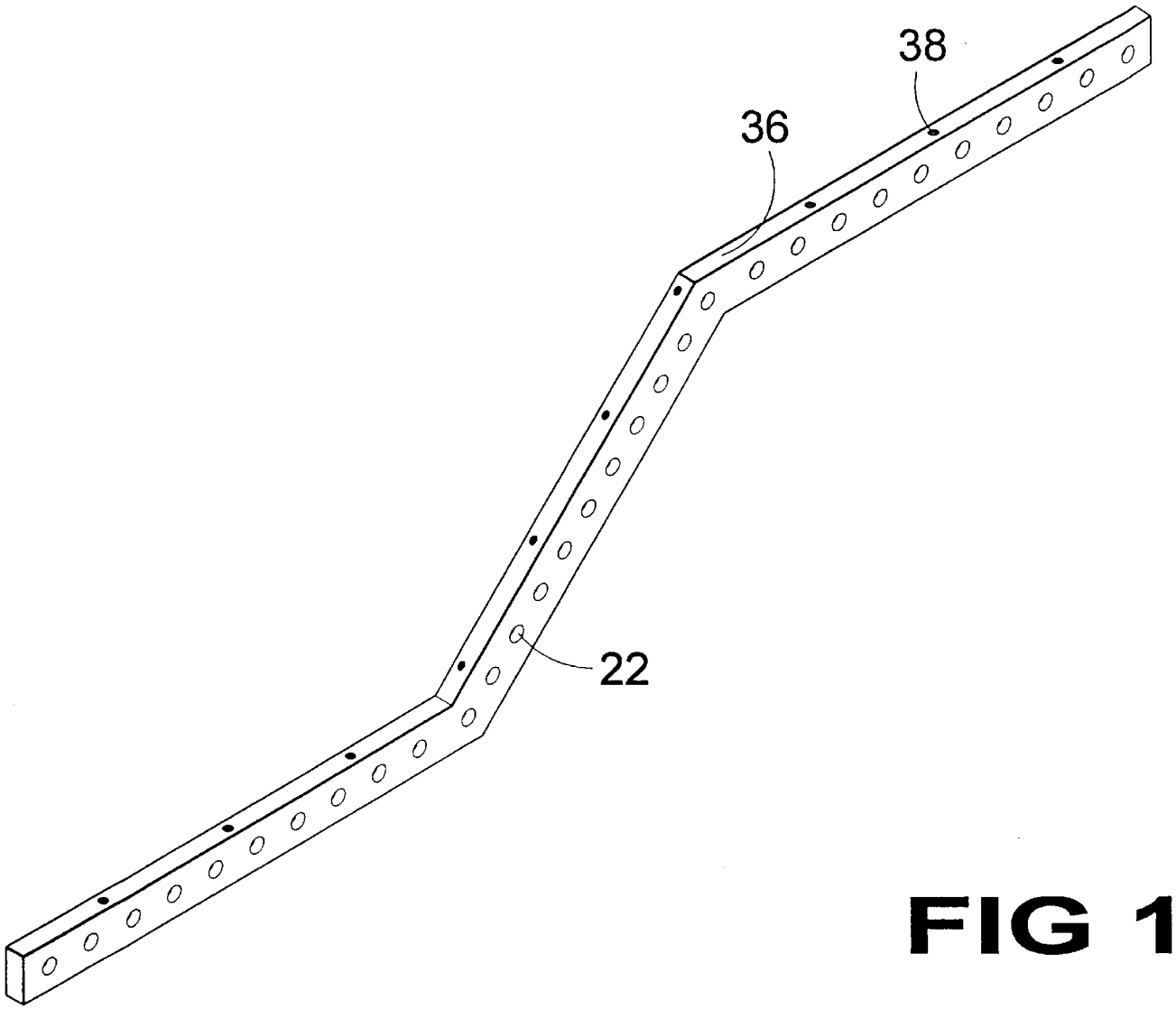
FIG. 16 is an exploded perspective view of the other additional embodiment of bracket of the present invention. Shown is one possible variation to the shape of the bracket member with a plurality of fastener mounting apertures whereby the shelf module can be mounted without regard to stud location.

Turning to FIG. 16, therein is shown an exploded perspective view of another additional embodiment of the bracket 36 of the present invention. Shown is one possible variation to the shape of the bracket member 36 having a plurality of fastener mounting apertures 22 whereby the shelf module (not shown) can be mounted without regard to stud location. Also shown are the threaded holes 38.

What is claimed is new and desired to be protected by Letters Patent is set forth in the claims:

1. A modular shelf system, comprising:

a) a pair of brackets for mounting on a wall;

b) said brackets having means for mounting on a wall;

c) said brackets having multiple forwardly projecting cantilevered male members connected to said brackets by hinges;

d) a shelf in the shape of a triangle for mounting in a corner of a wall; and, e) said shelf having multiple female apertures therein for receiving said male cantilevered members of said brackets whereby said shelf is mounted onto the corner of said wall.

2. The apparatus of claim 1, wherein said means for mounting on a wall further comprise multiple apertures.

3. The apparatus of claim 2, wherein said means for mounting on a wall further comprise screws.

4. The apparatus of claim 1, wherein said bracket further comprises metal.

5. The apparatus of claim 1, wherein said male members are slidably mounted into said female apertures.

6. The apparatus of claim 1, wherein said male members and said female apertures are two in number.

* * * * *